US006647223B2

(12) United States Patent
Ishii

(10) Patent No.: US 6,647,223 B2
(45) Date of Patent: Nov. 11, 2003

(54) OPEN/CLOSE SWITCH MECHANISM FOR USE IN AN IMAGE FORMING APPARATUS

(75) Inventor: Hiroshi Ishii, Ohta-Ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/973,692

(22) Filed: Oct. 11, 2001

(65) Prior Publication Data

US 2002/0041775 A1 Apr. 11, 2002

(30) Foreign Application Priority Data

Oct. 11, 2000 (JP) ..... 2000-310035
Sep. 6, 2001 (JP) ..... 2001-270236

(51) Int. Cl.[7] ..... G03G 15/00; G03G 21/00
(52) U.S. Cl. ..... 399/90; 399/124; 399/411
(58) Field of Search ..... 399/88, 90, 124, 399/403, 411

(56) References Cited

U.S. PATENT DOCUMENTS 3,692,401 A * 9/1972 Kawai ..... 399/411
4,165,168 A * 8/1979 Baumann et al. ..... 399/124
4,671,644 A * 6/1987 Sumida et al. ..... 399/124
6,088,553 A * 7/2000 Kuwata et al. ..... 399/124 X
6,125,251 A * 9/2000 Shiraishi et al. ..... 399/124

FOREIGN PATENT DOCUMENTS

| | | | |
|---|---|---|---|
| JP | 7-92879 | * | 4/1995 |
| JP | 07-092879 | | 4/1995 |
| JP | 2000-214645 | | 8/2000 |
| JP | 2001-125331 | * | 5/2001 |
| JP | 2001-152726 | * | 6/2001 |

* cited by examiner

*Primary Examiner*—Fred L Braun
(74) *Attorney, Agent, or Firm*—Oblon, Spivak, McClelland, Maier & Neustadt, P.C.

(57) ABSTRACT

A door open/close switch mechanism, which turns on and off predetermined power of an image forming apparatus in conjunction with an open/close operation of an open/close portion of the image forming apparatus, includes an operating member, a switch and an on/off member. The operating member moves in a first direction when a first open/close portion of the image forming apparatus is opened/closed while the operating member moves in a second direction when a second open/close portion of the image forming apparatus is opened/closed. The switch is provided to turn on and off the predetermined power of the image forming apparatus. The on/off member is integrally provided with the operating member and turns the switch on only when the on/off member moves to a predetermined position after moved in both the first and second directions.

27 Claims, 11 Drawing Sheets

OPEN/CLOSE SWITCH MECHANISM FOR USE IN AN IMAGE FORMING APPARATUS

CROSS-REFERENCE TO RELATED APPLICATIONS

This application is related to and claims priority, under 35 U.S.C. §119, from Japanese Patent Application Publication No. 2000-310035, filed in the Japanese Patent Office on Oct. 11, 2000, and Japanese Patent Application Publication No. 2001-270236, filed in the Japanese Patent Office on Sep. 6, 2001, wherein the entire contents of both Japanese Patent Application Publications are hereby incorporated by reference herein.

BACKGROUND OF THE INVENTION

1. Field of the Invention

This invention relates to an open/close switch mechanism to be used in an image forming apparatus, such as a copying machine, a printer and so forth, and more particularly to the open/close switch mechanism that has a simple configuration.

2. Discussion of the Background

Generally, an image forming apparatus, such as a printer, a facsimile, a copying machine, and so forth includes a plurality of open/close portions (e.g., a door) to replace toner with new one and to remove a jammed sheet, etc. The image forming apparatus needs to be configured such that an image forming operation can be performed only when all of the open/close portions are closed. Thus, it is necessary to provide a device to detect an open/close operation of an open/close portion so that the image forming operation is not performed when at least one of open/close portions is opened.

Further, various types of optional apparatuses, such as a sorter, a stapler, and the like are generally installed to the image forming apparatus. When a transfer sheet is jammed in the optional apparatus, the jammed transfer sheet must be removed. Then, an open/close operation of an open/close portion (i.e., such as a door) of the optional apparatus needs to be detected. Thus, the image forming apparatus is required to perform an image forming operation only when all of the open/close portions including those of the optional apparatus are closed, and to prohibit the image forming operation when at least one of the open/close portions is opened.

As one of methods to accomplish the above-described objective, an open/close detection switch may be provided to each open/close portion (i.e., a first method). As another method to accomplish the above-described objective, the operating order of the open/close portions may be arranged so that a following open/close portion is not closed (or opened) unless a predetermined open/close portion is mechanically closed (or opened) (i.e., a second method). As still another method, a link mechanism, with which each open/close portion is linked, maybe employed to turn a switch off when at least one of the open/close portions is opened (i.e., the switch is not turned on unless alt of the open/close portions are closed) (i.e. a third method).

According to the first method, the number of switches are required corresponding to the number of open/close portions, resulting in an increase in costs. According to the second method, the number of the switches can be reduced. However, when a user opens (or closes) the open/close portion without following the operating order of the open/close portions, the user needs to open (or close) the open/close portions again according to the operating order of the open/close portions, which is extra work for the user. Further, the open/close portion may be damaged when the open/close portion is forcibly closed without following the operating order of the open/close portions. In the third method, the link mechanism is generally apt to be complicated which may beat an effect produced by reducing the number of the switches, or the open/close portion may not be opened (or closed) without exerting a greater force.

For example, Japanese Patent Laid-Open Publication No. 7-92879 describes a door open/close switch mechanism in which an apparatus is put in a non-operational state when a first door is opened, and the first door cannot be closed when a second door is opened. In addition, Japanese Patent Laid-Open Publication No. 2000-214645 discloses a door open/close switch mechanism using a link mechanism. However, the mechanisms described in these publications are complicated as compared to a method in which a door open/close detection switch is provided to each door.

SUMMARY OF THE INVENTION

The present invention has been made in view of the above-mentioned and other problems and addresses the above-discussed and other problems.

The present invention advantageously provides a novel open/close switch mechanism to be used in an image forming apparatus at a reduced cost wherein a detection of an open/close operation of an open/close portion is performed without arranging the operating order of the open/close portions and reducing an operability of the open/close portions.

According to an example of the present invention, the open and close switch mechanism includes: an operating member configured to operate in first and second directions by the open and close operation of first and second open and close portions, respectively, of the image forming apparatus; a switch configured to turn the predetermined power of the image forming apparatus on and off; and an on and off member which is provided integrally with the operating member and is configured to turn the switch on only when the operating member operates in both the first and second directions.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
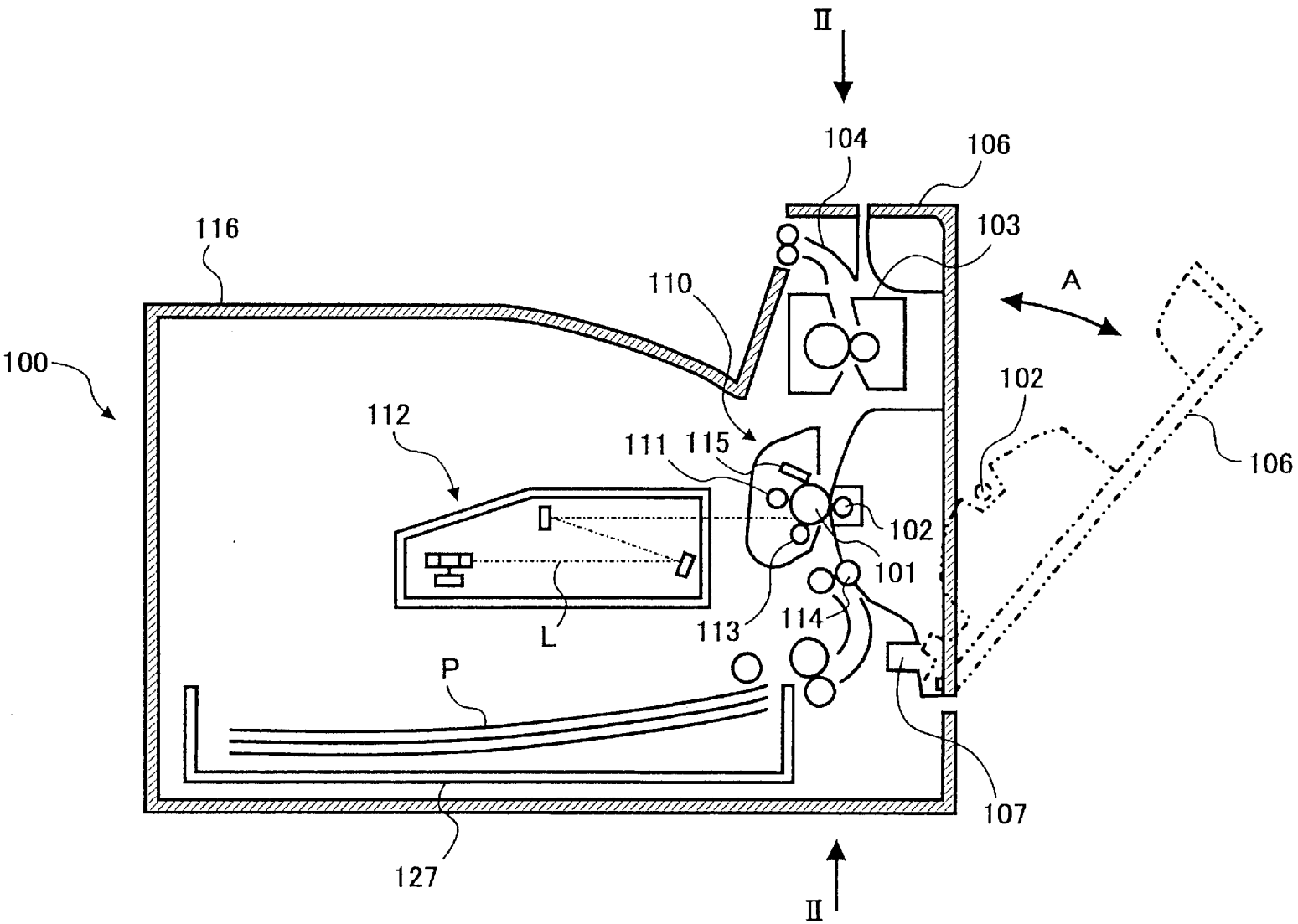
FIG. 1 is a drawing illustrating a construction of an image forming apparatus to which an open/close switch mechanism is applied.

Referring now to the drawings, wherein like reference numerals designate identical or corresponding parts throughout the several views, an example of the present invention is described below with reference to the following figures. FIG. 1 is a drawing illustrating a construction of an image forming apparatus (i.e., printer) 100 to which an open/close switch mechanism, according to an example of the present invention, is applied. As illustrated in FIG. 1, the image forming apparatus includes a photoconductive element 101 as an image bearing member. Around the photoconductive element 101 are a charging device 111, an exposure device 112, a developing device 113 (i.e., a developing roller), a transfer device 102 (i.e., a transfer bias roller), a cleaning device 115 (i.e., a cleaning blade), and a discharging lamp (not shown). The charging device 111 charges a surface of the photoconductive element 101 (i.e., by applying a voltage using a charging roller or the like). The exposure device 112 irradiates the surface of the photoconductive element 101 with, for example, a laser beam L to optically write an image corresponding to the image on an original document. An electrostatic latent image is formed on the surface of the photoconductive element 101. The developing device 113 forms a visible toner image on the surface of the photoconductive element 101 by supplying the electrostatic latent image formed on the surface of the photoconductive element 101 with toner. The transfer device 102 transfers the toner image, formed on the surface of the photoconductive element 101, onto a transfer sheet P which is a transfer medium. The cleaning device 115 cleans the photoconductive element 101 for the following printing process after the above-described image transfer process has been completed (i.e., residual toner remaining on the surface of the photoconductive element 101 is removed). The discharging lamp removes a residual potential remaining on the surface of the photoconductive element 101.

The transfer bias roller 102 and the photoconductive element 101 (which bears a toner image) form a transfer nip in which the transfer bias roller 102 and the photoconductive element 101 contact each other over a predetermined contacting width. A bias is applied to the transfer sheet P, which is conveyed to the nip, to electrostatically transfer the toner image formed on the surface of the photoconductive element 101 onto the transfer sheet P. Components provided around the photoconductive element 101, except for the transfer device 102, are unitized as a process cartridge unit 110 (hereinafter referred to as a PCU).

At a lower portion of the image forming apparatus 100, a sheet feeding device, including a sheet feeding tray 127 which is detachable/attachable to the main body of the apparatus, is provided. The transfer sheet P fed sheet-by-sheet from the sheet feeding device is conveyed to the transfer device 102 by a registration roller 114 with a predetermined timing. The toner image formed on the surface of the photoconductive element 101 is transferred onto the transfer sheet P by the transfer device 102. The toner image transferred onto the transfer sheet P is then fixed by a fixing device 103. The fixing device 103 includes a fixing roller having a heater inside and a pressing roller which is provided at a position opposed to the fixing roller so as to press-contact with the fixing roller. The fixing device 103 fixes the toner image transferred on the transfer sheet P by heat when the transfer sheet P is conveyed while being sandwiched between the fixing roller and the pressing roller. The transfer sheet P, on which the toner image is fixed by the fixing device 103, is discharged to an exit tray 116 via a sheet discharging path.

The reference numeral "106" denotes a right door (i.e., a first open/close portion) which is opened/closed with respect to the housing of the apparatus. The right door 106 is rotatably opened in a direction indicated by an arrow "A" in FIG. 1 so that a jammed transfer sheet can be removed. A pressing member 107 and the transfer device 102 (i.e., the transfer bias roller) are provided to the inner side of the right door 106.

Figure 2:
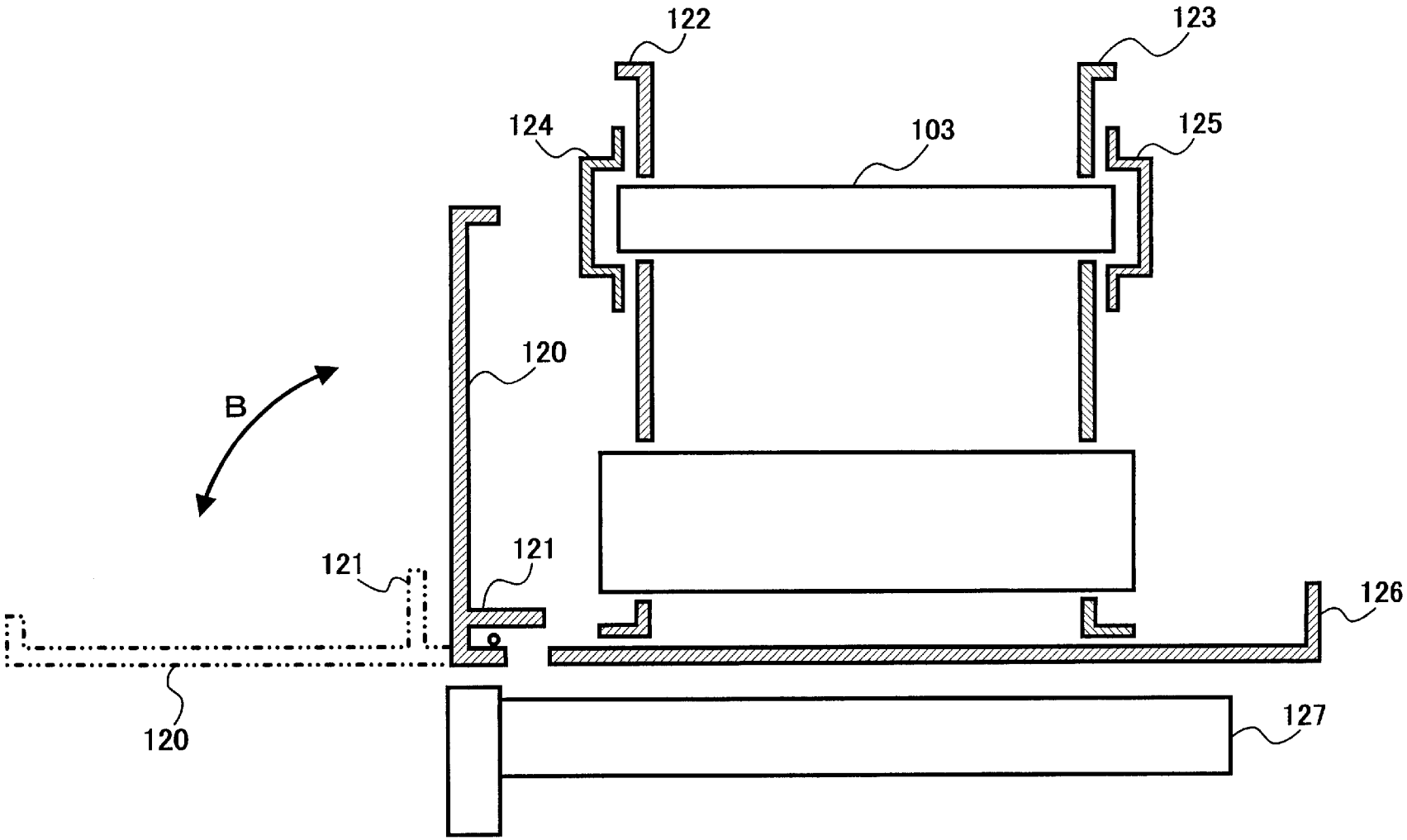
FIG. 2 is a cross section illustrating a sectional view of the image forming apparatus in FIG. 1 by cutting it along line indicated by "II—II"

FIG. 2 is a cross section illustrating a sectional view of the image forming apparatus in FIG. 1 by cutting it along a line II—II. The left side of FIG. 2 indicates the front side of the apparatus while the right side of FIG. 2 indicates the back side of the apparatus. As illustrated in FIG. 2, a front door 120 (i.e., a second open/close portion) is provided on the front side of the apparatus such that it can be opened/closed. The front door 120 is rotatably opened/closed in a direction indicated by an arrow "B" in FIG. 2 so that a user can replace the PCU 110, which includes the photoconductive element 101, the charging device 111 and the cleaning device 115, when the PCU 110 is at the end of its useful life or is in the event of trouble. A pressing member 121 is provided to the inner side of the front door 120. In the apparatus, a front side plate 122 and a rear side plate 123 are provided on a main body base 126. The fixing device 103 is supported by the front side plate 122 and the rear side plate 123 via a front bracket 124 and a rear bracket 125, respectively.

Figure 3:
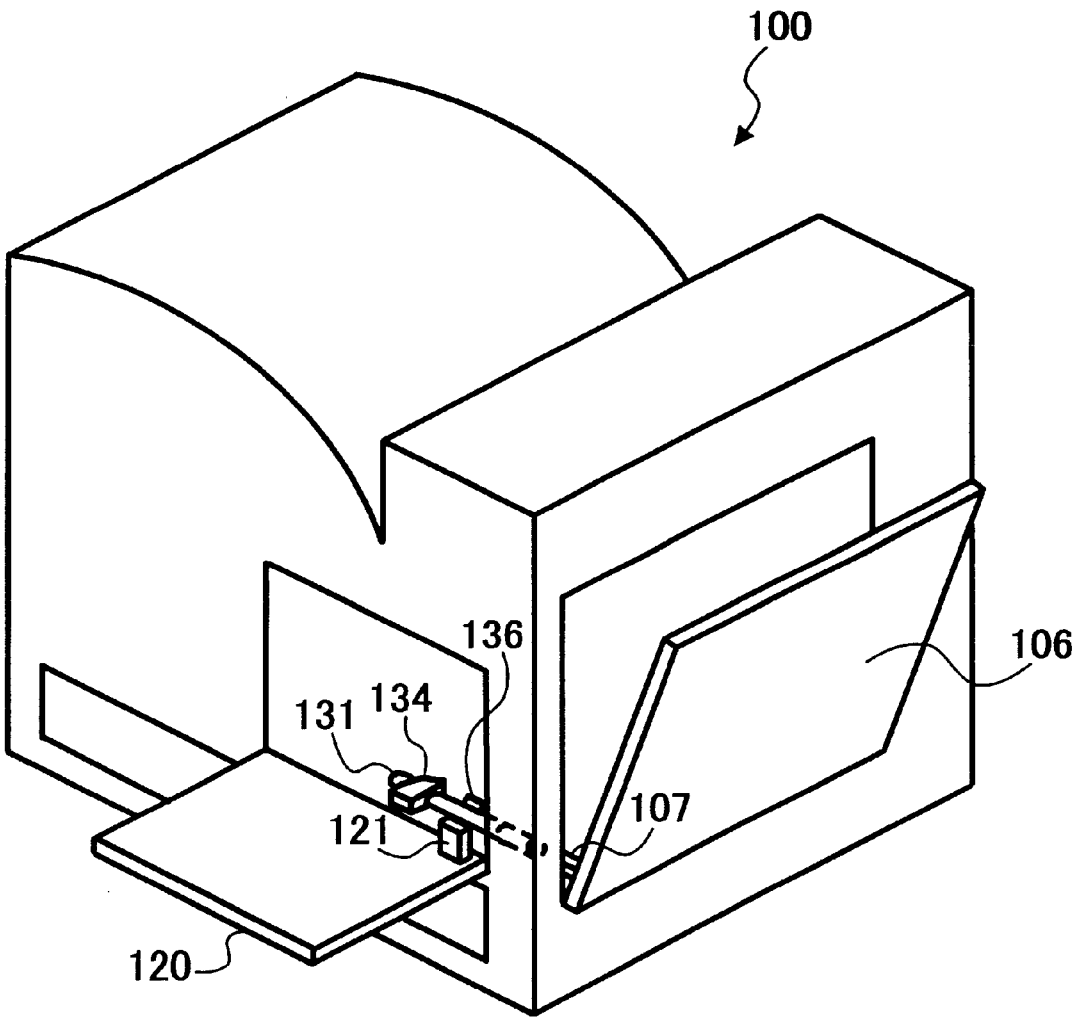
FIG. 3 is a drawing illustrating a perspective view of the image forming apparatus illustrated in FIG. 1.

FIG. 3 is a perspective view illustrating the image forming apparatus 100. As illustrated by the diagram, the front door 120 is rotatably opened over the bottom side thereof in a direction perpendicular to the transfer sheet P. The pressing member 121 is provided in the lower right corner of the front door 120 in a protruding manner. The right door 106 is rotatably opened over the bottom side thereof in a direction separating from the side of the image forming apparatus 100. The pressing member 107 is provided in the lower left corner of the right door 106 in a protruding manner. An arm (i.e., a shaft member) 131 is rotatably supported in parallel with the bottom side of the front door 120.

Figure 4A:
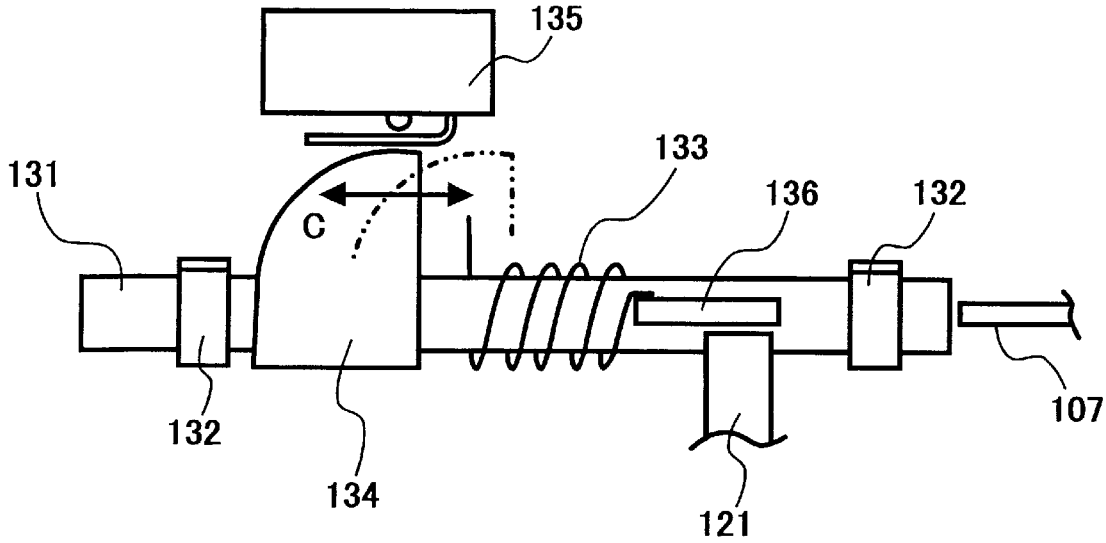
FIG. 4A is a drawing illustrating a front view of the door open/close switch mechanism.

As illustrated in FIG. 4A, the arm (i.e., the shaft member) 131, which is an operating member, is supported by the front side plate 122 via two clamps 132. The arm 131 is positioned such that the right end portion thereof opposes the pressing member 107 of the right door 106. The arm 131 is urged toward an axial direction (i.e., a first direction) and a rotating direction (i.e., a second direction) by a spring 133. A cam 134 (i.e., an ON/OFF member) in a predetermined shape is provided to the arm 131. The cam 134 changes its position based on the movement of the arm 131 in the axial and rotating directions.

A rib 136 is provided to the arm 131 at a position opposed to the pressing member 121 of the front door 120. As described below, a door open/close switch 135 is provided to the main body of the apparatus at a position opposed to the cam 134 when the right door 106 and the front door 120 are completely closed. The door open/close switch 135 turns on when a lever thereof is pressed, thereby enabling an image forming operation. That is, the door open/close switch 135 turns predetermined power of the image forming apparatus on and off, for example, the power for a laser in a writing system.

Figure 4B:
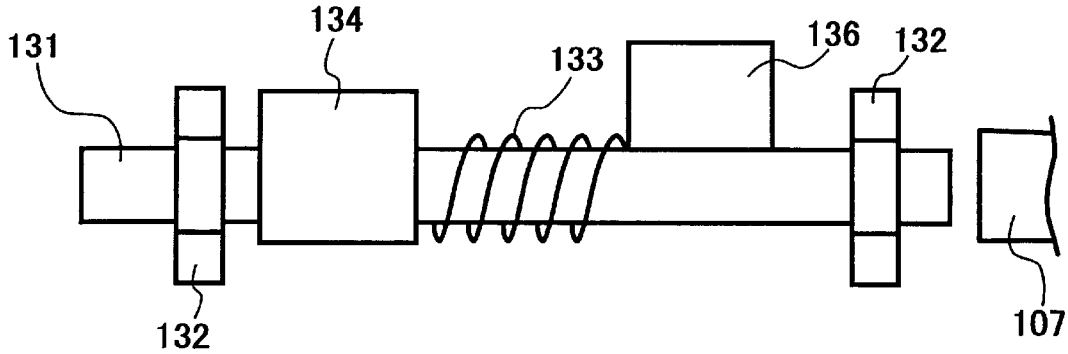
FIG. 4B is a drawing illustrating a plan view of the door open/close switch mechanism.
Figure 4C:
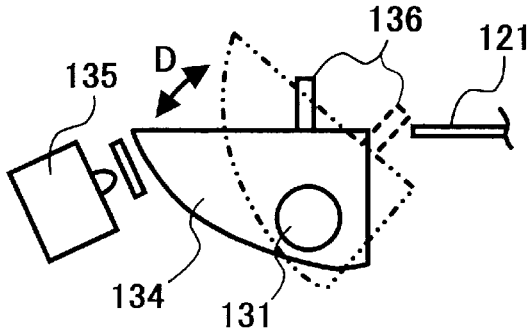
FIG. 4C is a drawing illustrating a side view of the door open/close switch mechanism.

Next, an operation of the above-configured image forming apparatus is described below. When the right door 106 is closed, the right end of the arm 131 is thrust by the pressing member 107 of the right door 106. Thus, the arm 131 moves to the left in FIG. 4A by compressing the spring 133. The cam 134 then moves in the axial direction from a position indicated by a dotted line to a position indicated by a solid line in FIG. 4A (i.e., in a direction indicated by an arrow "C"). When the front door 120 is closed after the right door 106 is closed, the pressing member 121 of the front door 120 thrusts the rib 136 of the arm 131. Thus, the arm 131 rotates on its axis by compressing the spring 133. The cam 134 then rotates from a position indicated by a dotted line to a position indicated by a solid line in FIG. 4C (i.e., in a direction indicated by an arrow "D"). The rotated cam 134 presses the lever of the door open/close switch 135, thereby turning on the door open/close switch 135. The apparatus is then ready to use.

The same result as described above can be achieved when the front door 120 is closed first and then the right door 106 is closed. Namely, when the front door 120 is closed, the pressing member 121 of the front door 120 thrusts the rib 136 of the arm 131. The cam 134 rotates together with the arm 131 from the position indicated by the dotted line to the position indicated by the solid line in FIG. 4C (i.e., in the direction indicated by the arrow "D").

When the right door 106 is closed after the front door 120 is closed, the right end of the arm 131 is thrust by the pressing member 107 of the right door 106. The cam 134 moves together with the arm 131 in the axial direction from the position indicated by the dotted line to the position indicated by the solid line in FIG. 4A (i.e., in the direction indicated by the arrow "C"). As a result, the moved cam 134 presses the lever of the door open/close switch 135 to turn on the door open/close switch 135. Thus, the apparatus is ready to use.

When the right door 106 is opened while the front door 120 is closed, the pressing force exerted by the pressing member 107 is released. The arm 131 moves in the axial direction by the spring force of the spring 133. Thus, the cam 134 moves to the right in FIG. 4A, namely from the position indicated by the solid line to the position indicated by the dotted line in FIG. 4A (i.e., in the direction indicated by the arrow "C"). The cam 134 is separated from the door open/close switch 135. The door open/close switch 135 is then turned off.

Thus, the apparatus is put into a state in which an image forming operation cannot be performed. When the front door 120 is opened after the right door 106 is opened, the pressing force exerted by the pressing member 121 is released. The arm 131 is rotated by the spring force of the spring 133. Namely, the cam 134 is rotated from the position indicated by the solid line to the position indicated by the dotted line in FIG. 4C (i.e., in the direction indicated by the arrow "D").

The same result as described above can be achieved when the front door 120 is opened first and then the right door 106 is opened. That is, when the front door 120 is opened while the right door 106 is closed, the cam 134 moves together with the arm 131 from the position indicated by the solid line to the position indicated by the dotted line in FIG. 4C (i.e., in the direction indicated by the arrow "D"). The cam 134 is then separated from the door open/close switch 135. The door open/close switch 135 is turned off. Thus, the apparatus is put into a state in which an image forming operation cannot be performed.

When the right door 106 is opened after the front door 120 is opened, the pressing force exerted by the pressing member 107 is released. The arm 131 moves to the right in FIG. 4A by the spring force of the spring 133. The cam 134 thus moves from the position indicated by the solid line to the position indicated by the dotted line in FIG. 4A (i.e., in the direction indicated by the arrow "C"). When one of doors is opened even if the other door is closed, the door open/close switch 135 is turned off, thereby placing the apparatus into a state in which an image forming operation cannot be performed.

Figure 5:
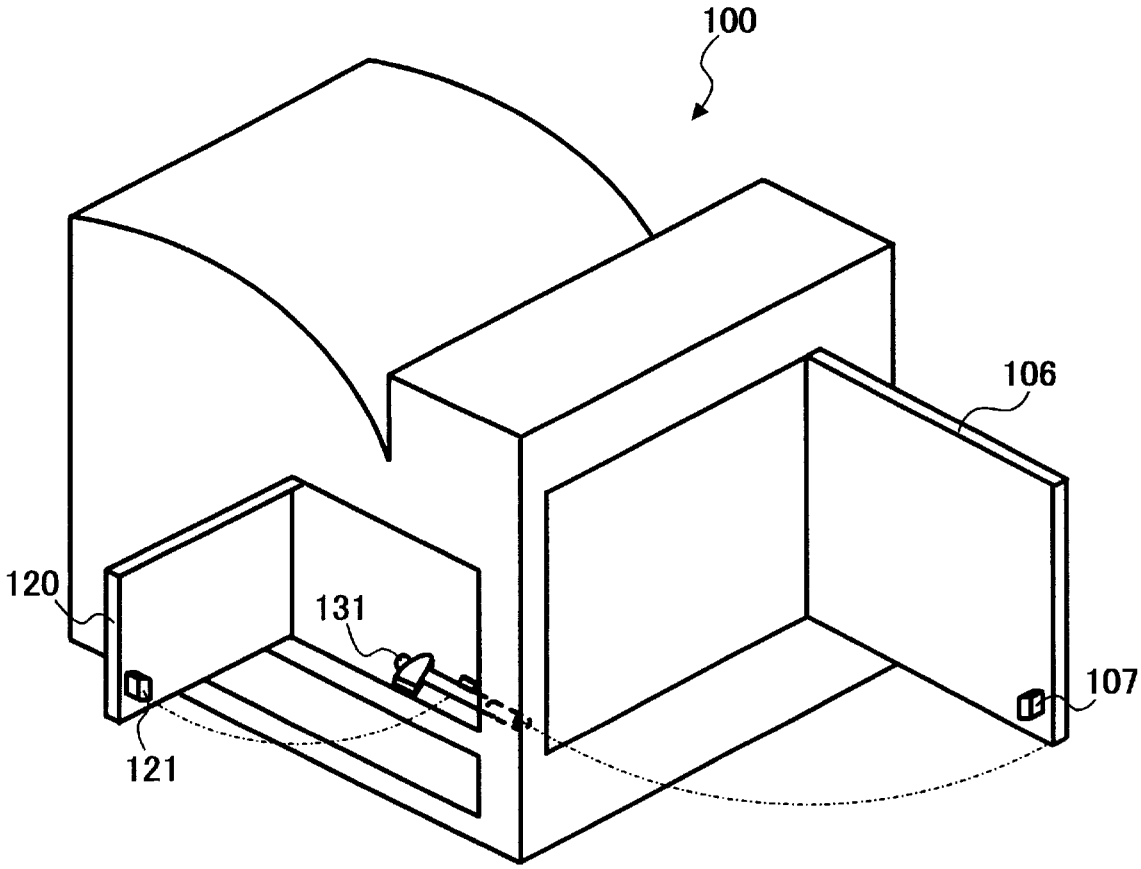
FIG. 5 is a perspective view illustrating another example of the image forming apparatus in which doors open in a different manner.

FIG. 5 is a perspective view illustrating another example of the image forming apparatus 100 in which doors open in a different manner. The front door 120 is rotatably opened over the left side thereof in a direction perpendicular to the transfer sheet P. The right door 106 is rotatably opened over the right side thereof (i.e., the side in the back side of the apparatus) in a direction separating from the side of the image forming apparatus 100. The pressing members 121 and 107 are provided to the front and right doors 120 and 106, respectively.

When the right door 106 is closed, the pressing member 107 abuts against an end surface of the arm 131 and thrusts the arm 131 in the axial direction. Further, when the front door 120 is closed, the pressing member 121 of the front door 120 thrusts the rib 136 to rotate the arm 131. As a result, the rotated cam 134 presses the lever of the door open/close switch 135 to turn on the door open/close switch 135 as in the case of the example shown in FIG. 3. The door open/close switch 135 is turned on even if the front door 120 is closed first and the right door 106 is then closed. The operation of the open/close switch mechanism when these doors are closed is similar to that of the example shown in FIG. 3.

As described above, according to the example of the present invention, the open/close switch mechanism includes the arm 131, the door open/close switch 135 and the cam 134. The arm 131 moves in the axial and rotating directions when the right door 106 is opened/closed and when the front door 120 is opened/closed, respectively. The door open/close switch 135 turns on and off predetermined power of the image forming apparatus. The cam 134 is integrally provided with the arm 131. The cam 134 turns the door open/close switch 135 on only when the cam 134 is brought to a predetermined position by the movement of the arm 131 in both the axial and rotating directions. Therefore, the right door 106 can be opened/closed irrespective of whether the front door 120 is opened or closed. Similarly, the front door 120 can be opened/closed irrespective of whether the right door 106 is opened or closed.

The right door 106 moves the arm 131 in the axial direction and the front door 120 moves the arm 131 in the rotating direction. Thus, an open/close operation of each door can be performed independently without being influenced by the open/close operation of the other door. Namely, according to the example of the present invention, a detection of an open/close operation of a door can be performed without arranging an operation of the door in a sequence and reducing an operability of the door. The configuration of the open/close switch mechanism is simple because a complicated link mechanism is not used, resulting in a decrease in costs.

Figure 6:
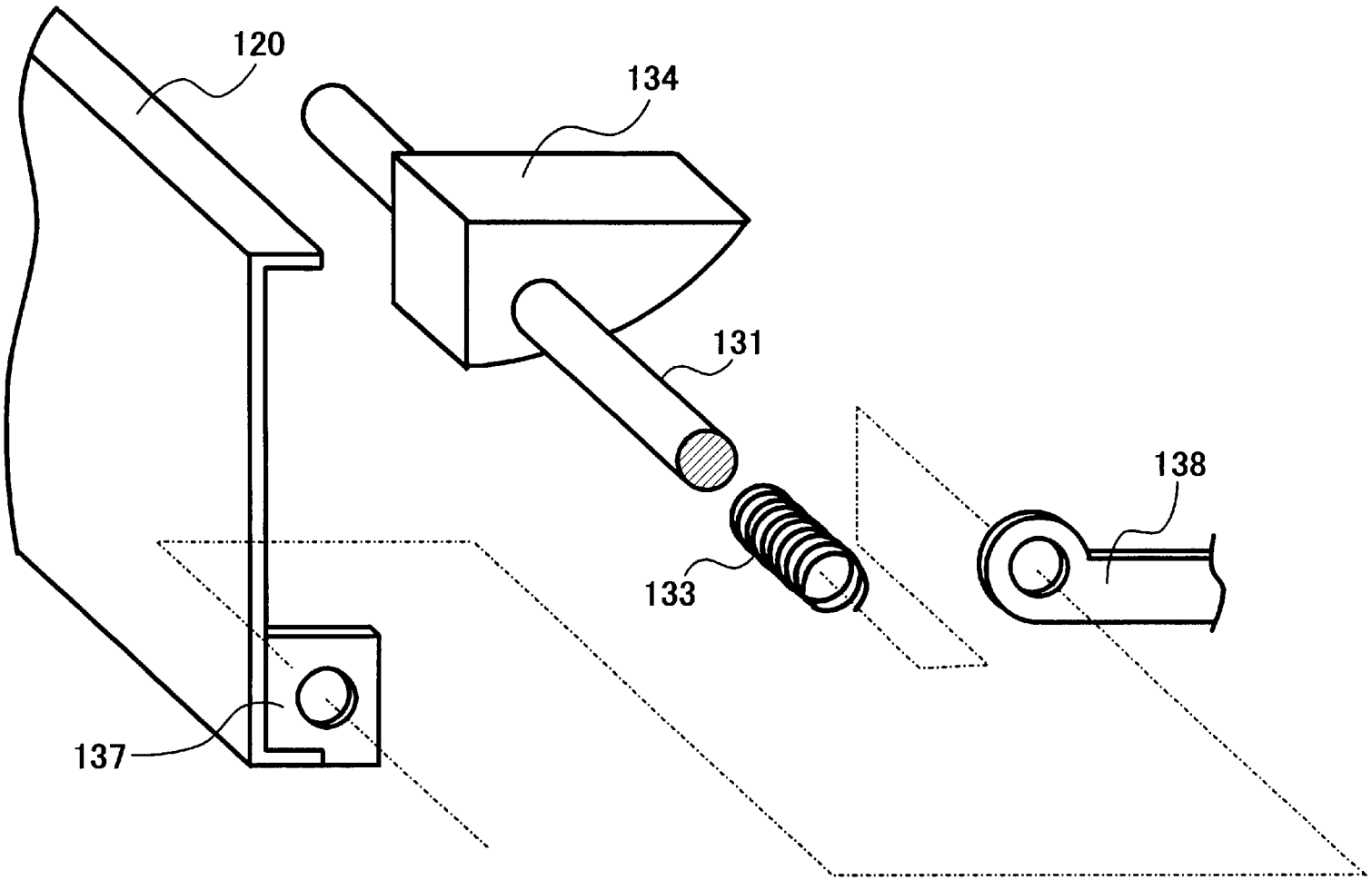
FIG. 6 is a perspective view illustrating another example of the door open/close switch constructed differently from that illustrated in FIGS. 4A–4C.

FIG. 6 is a drawing illustrating a construction of a supporting section of the front door 120 according to another example of the present invention. As illustrated in FIG. 4, the front door 120 is rotatably opened/closed by having the arm 131 run through a bearing 137 of the front door 120 and a hole of a bracket 138 which is provided to the front side plate 122. Namely, the arm 131 serves as an axis of the rotation of the front door 120. In this case, the bearing 137 has a D-shaped hole and the arm 131 has a D-shaped cross-section. Thus, the arm 131 does not move in the rotating direction with respect to the front door 120 although the arm 131 moves in the axial direction. That is, the arm 131 only moves in the rotating direction together with a rotating operation (i.e., an open/close operation) of the front door 120. The construction of the mechanism is similar to that of the above-explained example other than the above-described supporting section of the front door 120.

According to this example, when the front door 120 rotates, the arm 131 correspondingly rotates. Thus, the spring 133 applies a bias only in the axial direction. Further, the rib 136 and the pressing member 121 are not required, resulting in a decrease in costs.

In this example, the hole of the bearing 137 and the cross-section of the arm 131 are not limited to the D-shape. The shape may be freely selected (for example, oval-shaped or rectangular-shaped) as far as the front door 120 and the arm 131 are integrally rotated (i.e., the arm 131 does not rotate with respect to the front door 120).

A manner in which each door opens is not limited to the above-described examples. For example, the door may be configured to open/close in the combined manner of the examples shown in FIGS. 3 and 5 (i.e., in combination of doors that rotatably open over the bottom side and the right/left side of the door).

In addition, the position of the arm 131 is not limited to the above-described example. For example, the arm 131 may be provided at a position parallel to the top side of the front door 120 although the arm 131 is provided at the position parallel to the bottom side of the front door 120 in the examples shown in FIGS. 3 and 5. Further, the arm 131 may be provided at a position parallel to the top side or the bottom side of the right door 106. In this case, the pressing members 107 and 121 are provided at appropriate positions according to the position of the arm 131.

Figure 7:
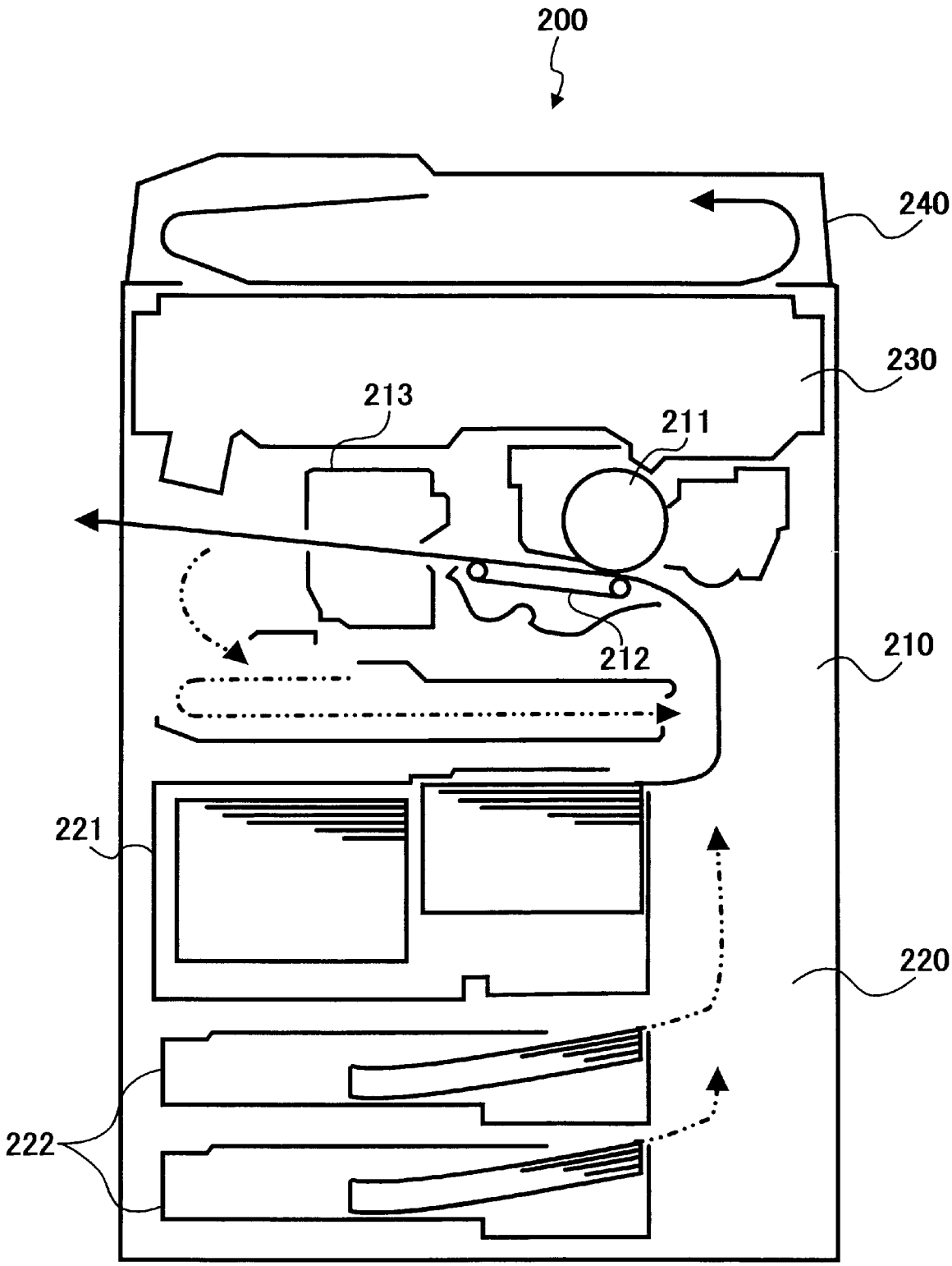
FIG. 7 is a cross section illustrating a sectional view of an image forming apparatus according to a second example of the present invention.
Figure 8:
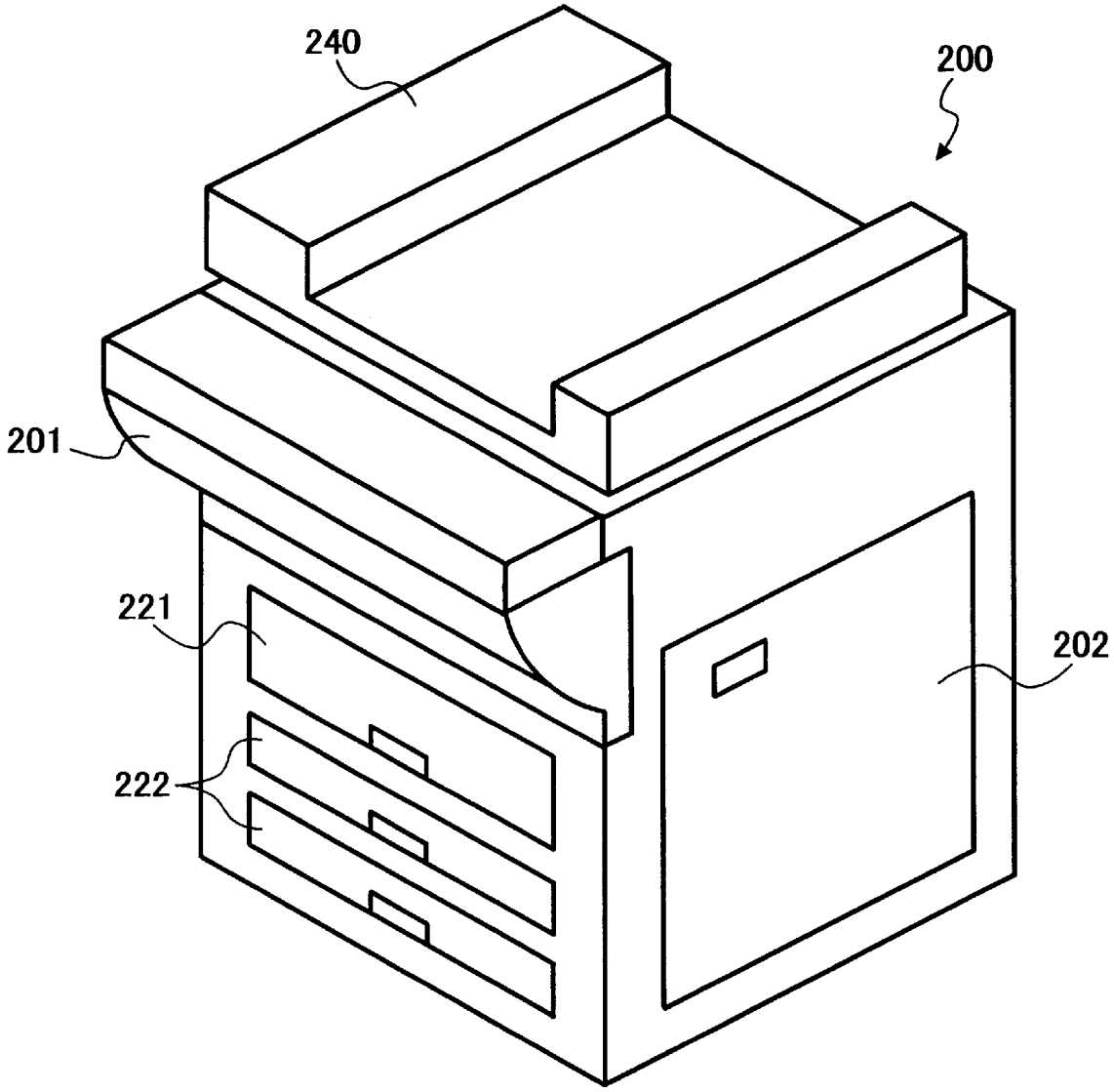
FIG. 8 is a perspective view of the image forming apparatus illustrated in FIG. 7.

Next, a second example of the present invention is described below. FIG. 7 is a schematic drawing illustrating a copying machine 200, as an image forming apparatus, in which an open/close switch mechanism according to the second example is used. FIG. 8 is a perspective view illustrating the copying machine 200.

As illustrated in FIG. 7, the copying machine 200 includes an image forming section 210 approximately in the center of the main body. The copying machine 200 further includes a sheet feeding device 220, an exposure device 230 and an ADF 240 (i.e., an automatic original document feeder). The sheet feeding device 220, the exposure device 230 and the ADF 240 are provided at a lower portion, an upper portion, and an upper surface of the main body of the copying machine 200, respectively.

In the image forming section 210, various devices required for an electrophotographic printing process are provided around a photoconductive drum 211. A transfer belt 212 is arranged under the photoconductive drum 211. A fixing device 213 is provided on the left side of the photoconductive drum 211. In a sheet feeding section 220, a sheet feeding tray 221 and a sheet feeding cassette 222 are arranged.

As illustrated in FIG. 8, a front door 201 (i.e., a first open/close portion) is provided on the front of the copying machine 200. The front door 201 is arranged at a position corresponding to the image forming section 210. When a transfer sheet is jammed while the transfer sheet is conveyed from the photoconductive drum 211 to the fixing device 213, the jammed transfer sheet is removed by opening the front door 201. In addition, the front door 201 is opened when replacing toner in a developing device with fresh one. The front door 201 is rotatable over the right side of the front door 201 (i.e., a vertical side at the right end).

A right door 202 (i.e., a second open/close portion) is provided to the right side of the copying machine 200. The right door 202 is arranged at a position corresponding to a transfer sheet conveyance path in the sheet feeding device 220. When a transfer sheet is jammed while the transfer sheet is conveyed from the sheet feeding device 220 to the photoconductive drum 211, the jammed transfer sheet is removed by opening the right door 202. The right door 202 is rotatable over the back side of the right door 202 (i.e., a vertical side of the right door 202 in the back side of the copying machine 200).

Figure 9A:
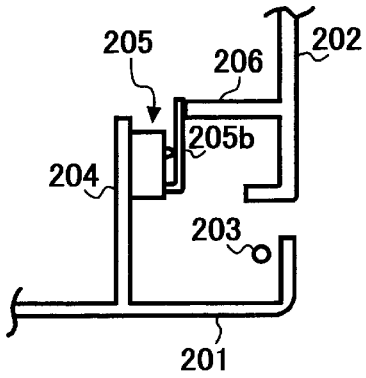
FIGS. 9A–9C are plan views illustrating a major part of an open/close switch mechanism used in the image forming apparatus illustrated in FIG. 7.
Figure 9B:
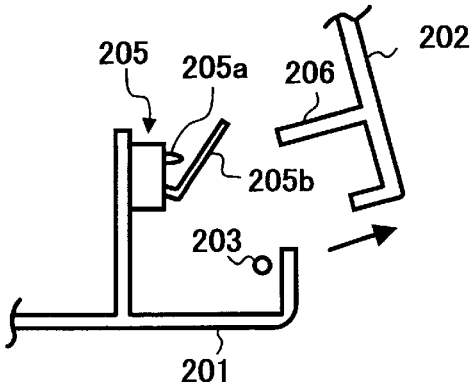
Figure 9C:
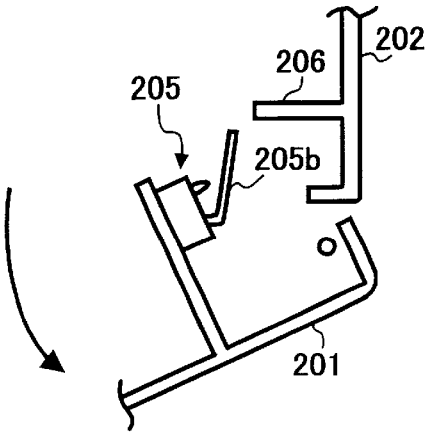

FIG. 9A is a plan view illustrating major components of the open/close switch mechanism according to the example of the present invention. In FIG. 9A, both the front and right doors 201 and 202 are closed. In FIG. 9B, the front door 201 is closed while the right door 202 is opened. In FIG. 9C, the front door 201 is opened while the right door 202 is closed. A circle 203 illustrated at the right edge portion of the front door 201 denotes the axis of rotation of the front door 201.

As illustrated in FIG. 9A, a rib 204 is provided to the inner surface of the front door 201 at a predetermined distance from the right end thereof such that the rib 204 protrudes toward inside of the copying machine 200. A door open/close switch 205 is provided on the right surface of the rib 204. A pressing member 206 is provided to the inner surface of the right door 202 at a predetermined distance from the front end thereof such that the pressing member 206 protrudes toward inside of the copying machine 200. The door open/close switch 205 includes a terminal rod 205*a* and a lever 205*b*. The lever 205*b* is urged such that it separates from the terminal rod 205*a*. Thus, the door open/close switch 205 is maintained in the off state unless external forces press the lever 205*b*. The door open/close switch 205 is turned on when the lever 205*b* is pressed and the terminal rod 205*a* is pressed into the door open/close switch 205.

A positional relationship between the door open/close switch 205 supported by the front door 201 and the pressing member 206 of the right door 202 is described below referring to FIGS. 9A–9C. As illustrated in FIG. 9A, when both doors 201 and 202 are closed, the pressing member 206 of the right door presses the lever 205*b* of the door open/close switch 205, thereby turning the door open/close switch on. When either the front door 201 or the right door 202 is opened, the pressing member 206 is separated from the lever 205*b*, thereby turning the door open/close switch off, as illustrated in FIGS. 9B and 9C.

As described above, according to the example of the present invention, the door open/close switch 205 is turned off when either of doors 201 and 202 is opened (the door open/close switch 205 is also turned off when both doors 201 and 202 are opened). The door open/close switch 205 is turned on when both doors 201 and 202 are closed.

According to the example of the present invention, a detecting device, without a complicated link mechanism, (i.e., the door open/close switch 205) detects an open/close operation of two open/close portions (i.e., the front and right doors 201 and 202) irrespective of the operation order of the two. As in the case of the above-described first example, when the door open/close switch 205 is turned off, an image forming operation in the copying machine 200 is prohibited.

According to the example of the present invention, an operating member, such as the arm 131 that operates in two directions is not required, resulting in a further reduction in costs. In addition, as the construction is simple, failures and malfunctions (i.e., an erroneous detection) are less likely to happen. The door open/close switch 205 may be provided to the right door 202 while arranging the pressing member 206 that abuts against the lever 205*b* at the front door 201. In addition, it may be configured such that an edge portion of the front door 201 directly abuts against the lever 205*b* of the door open/close switch 205 instead of employing the pressing member 206. A manner in which a door opens/closes differently from that which is described in this example may be adopted. For example, two doors may rotatably open/close over the bottom side of respective doors. Further, the construction of the door open/close switch 205 is not limited to that is described in this example and an arbitrary-constructed switch may be used.

Figure 10:
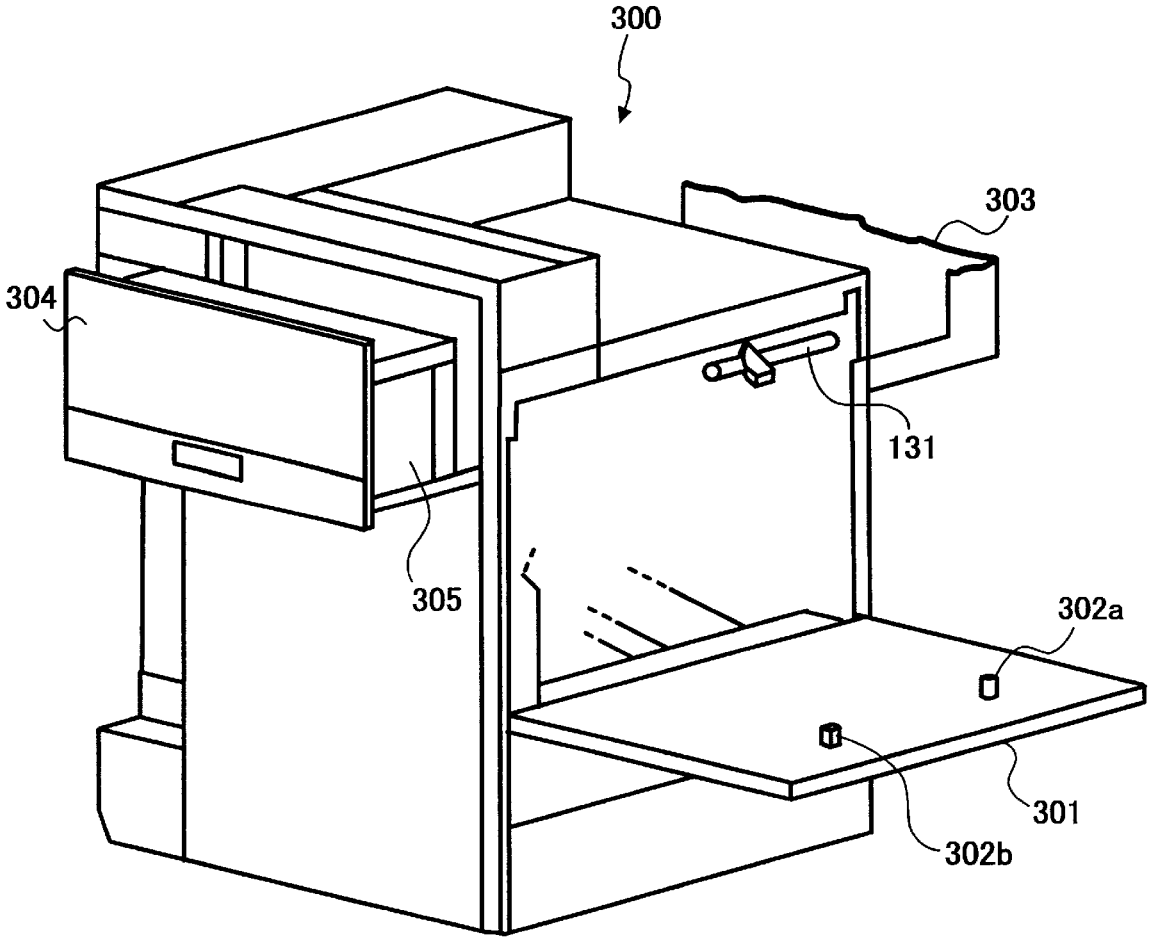
FIG. 10 is a perspective view illustrating a printer as a third example of the present invention.

Next, a third example of the present invention is described below. FIG. 10 is a perspective view illustrating a printer 300, as an image forming apparatus according to the third example of the present invention. A front door 301 (i.e., a first open/close portion) is arranged on the front of the printer 300. The front door 301 is rotatably opened over the bottom side thereof relative to the printer 300. Pressing members 302*a* and 302*b* are provided in a protruding manner at around upper end portion of the front door 301. A transfer sheet jammed in the main body of the printer 300 is removed by opening the front door 301. A right door 303 (i.e., a second open/close portion) is provided at the right side surface of the printer 300. The right door 303 is slid in the right outward direction to open it. The right door 303 is slid into the printer 300 when it is closed. Opening the right door 303 performs a replacement of a developing device such as a toner bottle (not shown).

In the printer 300, an open/close switch mechanism that detects an open/close operation of the front and the right doors 301 and 303 is provided. The open close switch mechanism is constructed similar to that illustrated in FIGS. 4A–4C. The arm 131 (i.e., the operating member) is provided inside the main body of the printer 300 at a position corresponding to around the upper end portion of the front door 301.

The arm 131 moves to the left in FIG. 4A when the right door 303 is closed. The arm 131 moves to the left in FIG. 4A when the right door 303 is opened. When the front door 301 is closed, the pressing member 302*a* thrusts the rib 136 (see FIG. 4C) protruding from the arm 131 so as to rotate the arm 131. Thus, the cam 134 (see FIGS. 4A–4C) turns on the door open/close switch 135 when both the front and right doors 301 and 303 are closed. When either of the two doors 301 and 303 is opened (including when both doors are opened), the cam 134 is separated from the door open/close switch 135 to turn the door open/close switch 135 off.

The right door 303 is opened/closed irrespective of whether the front door 301 is opened/closed. The front door 301 is opened/closed irrespective of whether the right door 303 is opened/closed. An open/close operation of each door can be performed independently with a same constant operational force without being influenced by the open/close operation of the other door. With this configuration, a detection of an open/close operation of a door can be performed without arranging an operational order of the doors and reducing an operability of the doors. Because a complicated link mechanism is not used, the construction is simple, resulting in a decrease in costs.

A unit 304 including a fixing device 305 is provided to the printer 300 such that the unit 304 slidably moves relative to the main body of the printer 300. The unit 304 includes an open/close portion that opens and closes when the unit 304 is slid out and slid into the main body of the printer 300, respectively. An open/close switch mechanism can be provided to the front door 301 and the unit 304. In this case, the front door 301 is a first open/close portion and the unit 304 is a second open/close portion. The open/close switch mechanism is constructed similar to that illustrated in FIGS. 4A–4C but is configured to be symmetric with respect to the open/close switch mechanism in FIGS. 4A–4C. The open/close switch is provided on the left side in the main body of the printer 300 at a position corresponding to around upper portion of the front door 301.

Namely, the arm 131 moves to the right in FIG. 10 (i.e., toward inside of the printer 300) when the unit 304 is slid into the main body. The arm 131 moves in the other direction when the unit 304 is slid out of the main body. When the front door 301 is closed, the pressing member 302*b* thrusts the rib 136 (see FIG. 4C) protruding from the arm 131 and rotates the arm 131. Thus, the door open/close switch 135 (see FIGS. 4A–4C) is turned on when both the front door 301 and unit 304 are closed. The door open/close switch 135 is turned off when either the front door 301 or unit 304 is opened (including when both the front door 301 and unit 304 are opened).

As described above, according to the present invention, an open/close operation of a sliding door or unit is detected by providing a switch mechanism in addition to the detection of the open/close operation of the door having a rotating fulcrum. In this case, an arrangement of the order of the open/close operation is not required and the operability of the sliding door or unit is not reduced.

Next, a fourth example of the present invention is described below. In this example, the present invention is applied to an open/close switch mechanism of an image forming apparatus to which an optional apparatus is installed.

Figure 11:
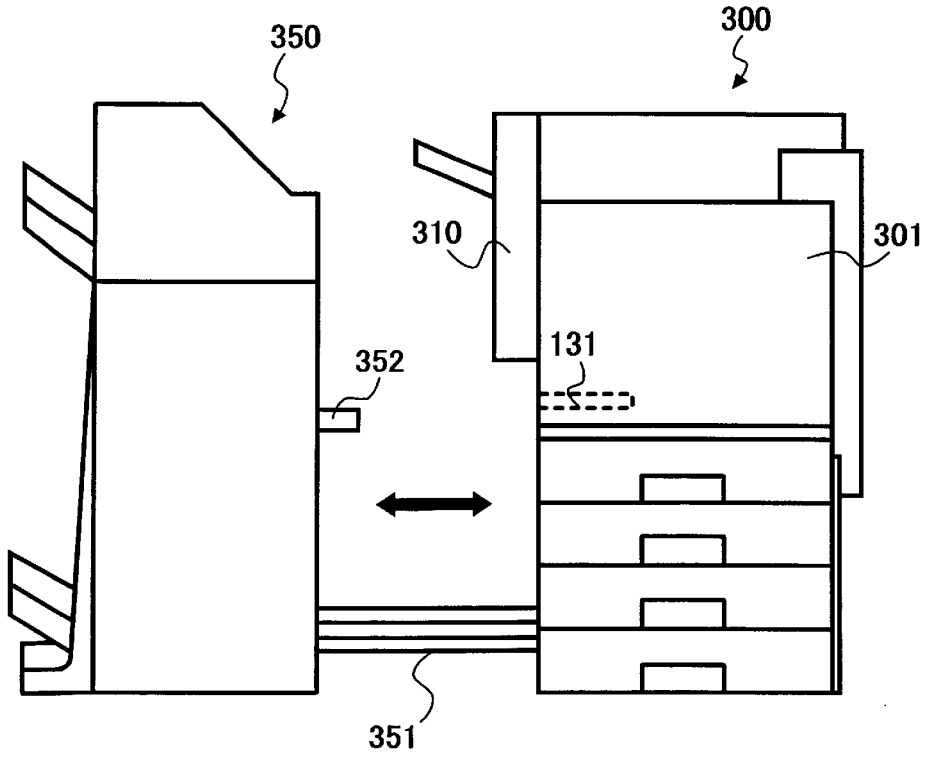
FIG. 11 is a front view illustrating an image forming system as a fourth example of the present invention.

In the image forming apparatus illustrated in FIG. 11, an optional finisher 350 is installed to the printer 300. When an aftertreatment is performed by the finisher 350, a transfer sheet discharged from the main body of the printer 300 is conveyed to the finisher 350 via a sheet reversing unit 310 which is provided to the side of the printer 300. The finisher 350 collates the pages of a plurality of printed transfer sheets or staples them. The finisher 350 is slidable by running on rails 351.

The finisher 350 is generally attached to the side of the main body of the printer 300 having the sheet reversing unit 310 therebetween. When a transfer sheet is jammed while being conveyed from the reversing unit 310 to the finisher 350, the finisher 350 is slid on the rails 351 in a direction separating from the main body of the printer 300 and sheet reversing unit 310 in order to remove the jammed transfer sheet. In FIG. 11, the finisher 350 is separated from the main body of the printer 300 and sheet reversing unit 310 for removing the jammed transfer sheet.

In this example, the front door 301 is a first open/close portion and the finisher 350 is a second open/close portion. An open/close switch is provided at a position between the first open/close portion (i.e., the front door 301) and the second open/close portion (i.e., the finisher 350). The open/close switch is constructed similar to that illustrated in FIGS. 4A–4C but is configured to be symmetric with respect to the switch in FIGS. 4A–4C.

As illustrated in FIG. 11, the arm 131 is provided in the main body of the printer 300 at a position corresponding to a left lower end portion of the front door 301. As in the example illustrated in FIGS. 4A–4C, the spring 133, the cam 134, and the rib 136 are provided to the arm 131. A pressing member 352 protruding from the right side surface of the finisher 350 is provided such that the pressing member 352 abuts against the left edge surface of the arm 131. When the finisher 350 is attached to the main body of the printer 300, the pressing member 352 thrusts the arm 131 to move the arm 131 to the right in FIG. 11. When the finisher 350 is separated from the main body of the printer 300, the pressing force exerted to the arm 131 by the pressing member 352 is released. The arm 131 then moves to the left in FIG. 11. When the front door 301 is closed, the pressing member 302*b* (see FIG. 10) presses the rib 136 (see FIG. 4C) protruding from the arm 131 and rotates the arm 131. Thus the door open/close switch 135 (see FIGS. 4A–4C) is turned on when both the front door 301 and finisher 350 are closed. The door open/close switch 135 is turned off when either the front door 301 or finisher 350 is opened (including when both the front door 301 and finisher 350 are opened). When the door open/close switch 135 is turned off, an operation of the printer 300 including the finisher 350 is prohibited.

According to the example of the present invention, a switch mechanism is provided at a position between open/close portions of the main body of an image forming apparatus and an optional apparatus installed to the image forming apparatus, thereby detecting an attach/detach operation of the optional apparatus and an open/close operation of the open/close portion of the main body of the printer 300. In this case, an arrangement of the order of the attach/detach operation of the optional apparatus and the open/close operation of the open/close portion of the main body of the printer 300 is not required. Further, the operability in the attach/detach operation of the optional apparatus and the open close operation of the open/close portion of the main body of the printer 300 is not reduced.

Figure 12:
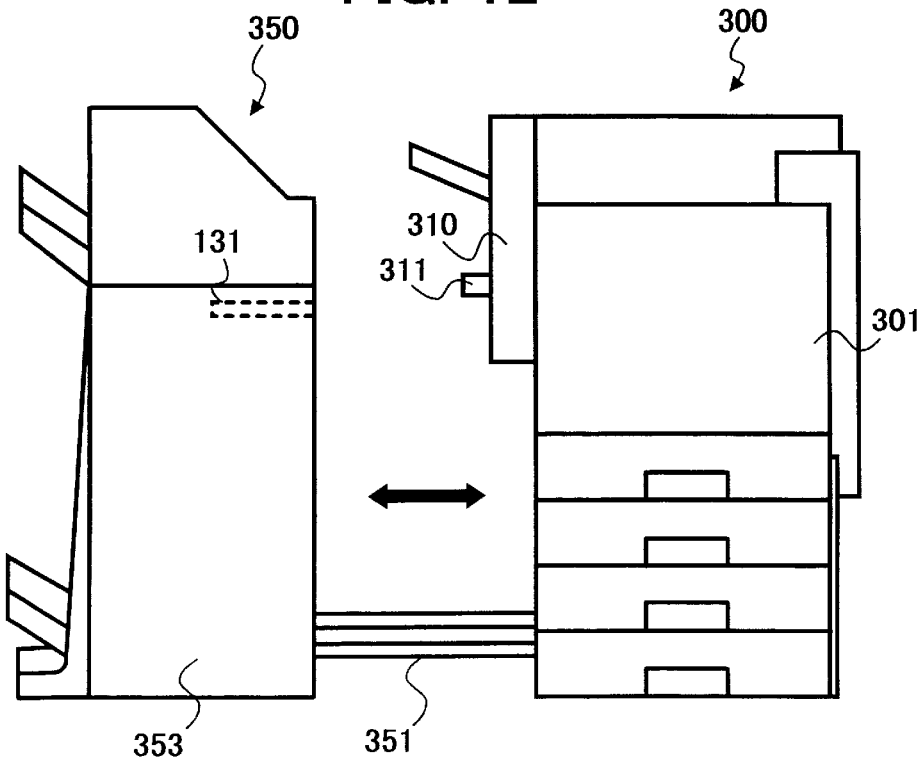
FIG. 12 is a front view of an image forming system, wherein the present invention is applied to an open/close portion of an optional apparatus.

FIG. 12 is a schematic drawing illustrating an example of an optional apparatus in which the present invention is applied to an open/close portion of the optional apparatus. A front door 353 is provided on the front of the finisher 350. The front door 353 rotatably opens/closes over the left side thereof (i.e., the left vertical side). The front door 353 is opened to remove a transfer sheet jammed in the finisher 350 or to replenish a stapler with a staple. As in the case of the example illustrated in FIG. 11, the finisher 350 is slidable by running on the rails 351. According to the example illustrated in FIG. 12, the front door 353 is a first open/close portion, and the finisher 350, which is attachable/detachable to the main body of the printer 300, is a second open/close portion. An open/close switch mechanism is provided at a position between the first open/close portion (i.e., the front door 353) and the second open/close portion (i.e., the finisher 350). The open/close switch mechanism is constructed similar to that illustrated in FIGS. 4A–4C.

As illustrated in FIG. 12, the arm 131 is provided in the main body of the printer 300 at a position corresponding to a right upper end portion of the front door 353. As in the example illustrated in FIGS. 4A–4C, the spring 133, the cam 134, and the rib 136 are provided to the arm 131. A pressing member (not shown) which thrusts the rib 136 is provided to the front door 353. A pressing member 311 is provided such that it protrudes from the side of the sheet reversing unit 310 at a position corresponding to the arm 131.

When the finisher 350 is attached to the main body of the printer 300 having the sheet reversing unit 310 therebetween, the pressing member 311 moves the arm 131 to the left in FIG. 11. When the front door 353 of the finisher 350 is closed, the pressing member (not shown) provided to the front door 353 abuts against the rib 136 of the arm 131 (see FIGS. 4A–4C) so as to rotate the arm 131. The cam 134 abuts against the door open/close switch 135 (see FIGS. 4A–4C) to turn the door open/close switch 135 on. The door open/close switch 135 then detects that the front door 353 is closed and the finisher 350 is set at an operation position. The detection of the door open/close switch 135 is performed irrespective of the order of the operations in which the front door 353 is closed and the finisher 350 is set.

When the finisher 350 is separated from the printer 300 and the sheet reversing unit 310, the pressing force exerted to the arm 131 by the pressing member 311 is released. The arm 131 then moves to the right in FIG. 12 by the spring force of the spring 133 (see FIGS. 4A–4C). The cam 134 is separated from the door open/close switch 135 so that the door open/close switch 135 is turned off. When the front door 353 of the finisher 350 is opened, the pressing member (not shown) is separated from the rib 136 (see FIGS. 4A–4C). The arm 131 is then rotated by the spring force of the spring 133 such that the cam 134 is separated from the door open/close switch 135. The door open/close switch 135 is thus turned off. Namely, the door open/close switch 135 is turned on and an image forming operation can be performed only when the finisher 350 is set to the printer 300 and the front door 353 of the finisher 350 is closed. When the front door 353 of the finisher 350 is opened or when the finisher 350 is separated from the printer 300 (or when the front door 353 is opened while the finisher 350 is separated from the printer 300), the door open/close switch 135 is turned off, thereby prohibiting an image forming operation.

According to the example of the present invention, an open/close operation of a door of an optional apparatus and an attach/detach operation of the optional apparatus can be detected in the optional apparatus shown in FIG. 12. In this case, an arrangement of the order of the open/close operation of the door and the attach/detach operation of the optional apparatus is not required and an operability in the open/close operation of the door and the attach/detach operation of the optional apparatus is not reduced.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. An open and close switch mechanism for use in an image forming apparatus, the open and close switch mechanism comprising:

an operating member which is a shaft member having a central longitudinal axis, the shaft member being configured to rotate in a rotational direction about the central longitudinal axis thereof by an open and close operation of a first open and close portion of the image forming apparatus, and the shaft member being configured to slide back and forth in an axial direction parallel to the central longitudinal axis thereof by an open and close operation of a second open and close portion of the image forming apparatus;

a switch configured to turn a predetermined power of the image forming apparatus on and off; and an on and off member integrally provided on the shaft member and configured to turn the switch on only when the shaft member operates in both the rotational and axial directions.

2. The open and close switch mechanism according to claim 1, further comprising:

a rib member integrally provided on and extending outwardly from an outer periphery of the shaft member, the rib member cooperating with a pressing member extending outwardly from an inner surface of the first open and close portion such that when the first open and close portion is in a closed state, the pressing member presses against the rib member to rotate all of the rib member, the shaft member, and the on and off member and thereby the on and off member presses a lever of the switch in order to activate the switch and turn the predetermined power of the image forming apparatus on.

3. The open and close switch mechanism according to claim 2, wherein:

the first open and close portion is configured to be a door, and the central longitudinal axis of the shaft member is configured to serve as an axis of rotation of the door and to rotate in the rotational direction integrally with the door.

4. The open and close switch mechanism according to claim 1, wherein:

the first open and close portion is configured to be a door, and the central longitudinal axis of the shaft member is configured to serve as an axis of rotation of the door and rotate in the rotational direction integrally with the door.

5. The open and close switch mechanism according to claim 1, wherein the second open and close portion is configured to slide.

6. The open and close switch mechanism according to claim 1, wherein at least one of the first and second open and close portions is an open and close portion of an apparatus installed to a main body of the image forming apparatus.

7. An open and close switch mechanism for use in an image forming apparatus, the open and close switch mechanism comprising:

a switch configured to turn a predetermined power of the image forming apparatus on and off, wherein:

the switch is provided on one of first and second open and close portions of the image forming apparatus such that the switch is turned on by the other of the first and second open and close portions only when both the first and second open and close portions are closed.

8. The open and close switch mechanism according to claim 7, wherein at least one of the first and second open and close portions is configured to slide.

9. The open and close switch mechanism according to claim 7, wherein at least one of the first and second open and close portions is an open and close portion of an apparatus installed to a main body of the image forming apparatus.

10. An open and close switch mechanism for use in an image forming apparatus, the open and close switch mechanism comprising:

operating means which is a shaft means having a central longitudinal axis, the shaft means for rotating in a rotational direction around the central longitudinal axis thereof by an open and close operation of a first open and close portion of the image forming apparatus, and the shaft means for sliding back and forth in an axial direction parallel to the central longitudinal axis thereof by an open and close operation of a second open and close portion of the image forming apparatus;

switch means for switching a predetermined power of the image forming apparatus on and off; and on and off means for turning the switch means on only when the shaft means operates in both the rotational and axial directions.

11. The open and close switch mechanism according to claim 10, further comprising:

a rib member integrally provided on and extending outwardly from an outer periphery of the shaft means, the rib member cooperating with a pressing member extending outwardly from an inner surface of the first open and close portion such that when the first open and close portion is in a closed state, the pressing member presses against the rib member to rotate all of the rib member, the shaft means, and the on and off means around the central longitudinal axis of the shaft means and in turn the on and off means presses a lever of the switch means in order to activate the switch means and turn the predetermined power of the image forming apparatus on.

12. The open and close switch mechanism according to claim 11, wherein:

the first open and close portion is configured to be a door, and the shaft means is configured to serve as an axis of rotation of the door and to rotate in the rotational direction integrally with the door.

13. The open and close switch mechanism according to claim 10, wherein:

the first open and close portion is configured to be a door; and the shaft means is configured to serve as an axis of rotation of the door and rotate in the rotational direction integrally with the door.

14. The open and close switch mechanism according to claim 10, wherein the second open and close portion is configured to slide.

15. The open and close switch mechanism according to claim 10, wherein at least one of the first and second open and close portions is an open and close portion of an apparatus installed to a main body of the image forming apparatus.

16. An open and close switch mechanism for use in an image forming apparatus, the open and close switch mechanism comprising:

switch means for switching a predetermined power of the image forming apparatus on and off, wherein:

the switch means is provided on one of first and second open and close portions of the image forming apparatus such that the switch means is switched on by the other of the first and second open and close portions only when both the first and second open and close portions are closed.

17. The open and close switch mechanism according to claim 16, wherein at least one of the first and second open and close portions is configured to slide.

18. The open and close switch mechanism according to claim 16, wherein at least one of the first and second open and close portions is an open and close portion of an apparatus installed to a main body of the image forming apparatus.

19. A method for turning predetermined power on and off in conjunction with an open and close operation of an open and close portion of an image forming apparatus, the method comprising the steps of:

operating an operating member, which is a shaft member having a central longitudinal axis, in a rotational direction around the central longitudinal axis of the shaft member by the open and close operation of a first open and close portion of the image forming apparatus, and in an axial direction parallel to the central longitudinal axis of the shaft member by the open and close operation of a second open and close portion of the image forming apparatus;

providing a switch configured to turn the predetermined power of the image forming apparatus on and off; and turning the switch on only when the shaft member operates in both the rotational and axial directions.

20. The method according to claim 19, further comprising:

providing the shaft member with an on and off member and a rib member both of which extend outwardly from an outer periphery of and are integrally attached to the shaft member, the rib member cooperating with a pressing member extending from the first open and close portions in order to rotate the shaft member about the central longitudinal axis thereof and thereby rotate the on and off member so that the on and off member contacts a lever of the switch to activate the switch to turn the predetermined power of the image forming apparatus on.

21. The method according to claim 20, wherein:

the first open and close portion is configured to be a door; and the shaft member is configured to serve as an axis of rotation of the door and to rotate in the rotational direction integrally with the door.

22. The method according to claim 19, wherein:

the first open and close portion is configured to be a door; and the shaft member is configured to serve as an axis of rotation of the door and to rotate in the rotational direction integrally with the door.

23. The method according to claim 19, wherein the second open and close portion is configured to slide.

24. The method according to claim 19, wherein at least one of the first and second open and close portions is an open and close portion of an apparatus installed to a main body of the image forming apparatus.

25. A method for turning predetermined power on and off in conjunction with an open and close operation of an open and close portion of an image forming apparatus, the method comprising the steps of:

providing a switch, configured to turn the predetermined power of the image forming apparatus on and off, on one of first and second open and close portions of the image forming apparatus; and turning the switch on by the other of the first and second open and close portions only when both the first and second open and close portions are closed.

26. The method according to claim 25, wherein at least one of the first and second open and close portions is configured to slide.

27. The method according to claim 25, wherein at least one of the first and second open and close portions is an open and close portion of an apparatus installed to a main body of the image forming apparatus.

* * * * *